US011199383B2

(12) United States Patent
Faudree, IV

(10) Patent No.: US 11,199,383 B2
(45) Date of Patent: Dec. 14, 2021

(54) DEVICE FOR CONTROLLING A RATE OF GAS PRESSURE INCREASE IN A GUN BARREL

(71) Applicant: Thomas Faudree, IV, Lakewood Ranch, FL (US)

(72) Inventor: Thomas Faudree, IV, Lakewood Ranch, FL (US)

( * ) Notice: Subject to any disclaimer, the term of this patent is extended or adjusted under 35 U.S.C. 154(b) by 0 days.

(21) Appl. No.: 17/013,805

(22) Filed: Sep. 7, 2020

(65) Prior Publication Data

US 2021/0140746 A1 May 13, 2021

Related U.S. Application Data

(63) Continuation of application No. 16/056,884, filed on Aug. 7, 2018, now Pat. No. 10,767,967.

(51) Int. Cl.
*F42B 5/16* (2006.01)
*C06D 5/00* (2006.01)

(52) U.S. Cl.
CPC . *F42B 5/16* (2013.01); *C06D 5/00* (2013.01)

(58) Field of Classification Search
CPC ..... C06D 5/06; C06D 5/00; F42B 5/16
(Continued)

(56) References Cited

U.S. PATENT DOCUMENTS 2,072,671 A 10/1934 Foulke
2,201,640 A 5/1940 Winnard
(Continued)

FOREIGN PATENT DOCUMENTS

EP 0159843 10/1985
IN 467/CHE/2007 1/2012

OTHER PUBLICATIONS

Ballistics Moderation of nitrocellulose based propellants. Ballistics Aug. 13, 2012 pp. 1 to 4.
(Continued)

*Primary Examiner* — John Cooper
(74) *Attorney, Agent, or Firm* — David J. Archer

(57) ABSTRACT

A device is disclosed for controlling a rate of gas pressure increase generated by a propellant for propelling a projectile from an upstream towards a downstream end of a gun barrel. The device includes a first surface area defined by the propellant and a deterrent applied to a second surface area defined by the first surface area, the second surface area being less than the first surface area. The arrangement is such that the second surface area defines a deterrent free third surface area of the propellant. A primer is operatively disposed relative to the third surface area such that when the primer is activated, the third surface area of the propellant is ignited. The arrangement is such that firstly, while the third surface area is burning and generating gas between the upstream end of the gun barrel and the projectile, the rate of gas pressure increase begins to propel the projectile towards the downstream end of the gun barrel. Secondly, the third surface area of the propellant while burning exposes a progressively increasing surface area of the propellant for burning together with an associated increased generation of gas, the increasing surface area of the propellant defining a concave crater, the crater having a wall which progressively increases in surface area during the burning such that the rate of increase in gas pressure continues to increase for accelerating the projectile towards the downstream end of the gun barrel.

6 Claims, 16 Drawing Sheets

(58) Field of Classification Search
USPC ..... 102/290, 289, 286, 285, 284, 283, 288
See application file for complete search history.

(56) References Cited

U.S. PATENT DOCUMENTS

| | | | | |
|---|---|---|---|---|
| 2,261,630 | A | | 11/1941 | Regestein |
| 2,575,871 | A | | 11/1951 | Stuart et al. |
| 2,771,351 | A | * | 11/1956 | Holmes ..... C06B 21/0083 102/290 |
| 2,787,533 | A | | 4/1957 | O'neill, Jr. et al. |
| 2,955,535 | A | * | 10/1960 | Show ..... F42B 3/04 102/202.5 |
| 3,000,175 | A | | 9/1961 | Lawrence |
| 3,000,716 | A | | 9/1961 | Lawrence et al. |
| 3,032,972 | A | | 5/1962 | Preckel |
| 3,099,963 | A | | 8/1963 | Dobrin et al. |
| 3,202,557 | A | * | 8/1965 | Kaufman ..... C08L 27/18 428/422 |
| 3,459,101 | A | | 11/1967 | Scanlon, Jr. et al. |
| 3,648,616 | A | | 3/1972 | Hsu |
| 3,706,278 | A | | 12/1972 | Stiefel et al. |
| 3,743,554 | A | | 7/1973 | Mellow |
| 3,920,494 | A | | 11/1975 | Kaufman |
| 3,948,697 | A | * | 4/1976 | Flanagan ..... C06B 45/10 149/11 |
| 3,957,548 | A | * | 5/1976 | Rohr ..... C06B 21/0083 149/10 |
| 4,000,024 | A | | 12/1976 | Roberto et al. |
| 4,072,546 | A | | 2/1978 | Winer |
| 4,180,424 | A | | 12/1979 | Reed, Jr. et al. |
| 4,354,884 | A | | 10/1982 | Williams |
| 4,373,976 | A | | 2/1983 | Flanagan et al. |
| 4,597,994 | A | * | 7/1986 | Bolinder ..... C06B 21/0083 427/213 |
| 4,950,342 | A | | 8/1990 | Canterberry |
| 5,198,615 | A | | 3/1993 | Robbie et al. |
| 5,325,782 | A | | 7/1994 | Strauss et al. |
| 5,524,544 | A | | 6/1996 | O'Meara et al. |
| 5,682,009 | A | | 10/1997 | O'Meara et al. |
| 5,726,378 | A | | 3/1998 | O'Meara et al. |
| 5,747,723 | A | | 5/1998 | Buckalew et al. |
| 5,970,877 | A | | 10/1999 | Hensler |
| 6,345,577 | B1 | * | 2/2002 | Cramer ..... C06B 45/24 102/288 |
| 6,415,715 | B1 | | 7/2002 | Nilsson et al. |
| 6,645,325 | B1 | | 11/2003 | Nickel |
| 6,688,232 | B2 | | 2/2004 | Griesbach et al. |
| 7,047,885 | B1 | | 5/2006 | Crickenberger et al. |
| 7,344,610 | B2 | | 3/2008 | Barrett et al. |
| 8,066,834 | B1 | | 11/2011 | Petersen et al. |
| 9,182,201 | B2 | | 11/2015 | Coffman |
| 2010/0300319 | A1 | | 12/2010 | Guindon |
| 2013/0305950 | A1 | | 11/2013 | Coffman |

OTHER PUBLICATIONS

Prasanna Kumar et al., Performance characteristics of solid propellants. Discovery, Mar. 3, 2015, pp. 44 to 62. vol. 29 No. 108.

Ludwig Stiefel, Thermochemical and burning rate properties of deterred US small arms propellants. Jul. 2, 1980, pp. 1 to 51, Technical report ARSCD-TR-80005.

David Reese, A review of solid propellant burn rate enhancement by mechanical methods, pp. 1 to 11.

Thelma Manning et al., Innovative boron nitride-doped propellants. ScienceDirect. Oct. 8, 2015, vol. 12, 2016, pp. 69 to80.

Kym M. Ide, Composite Propellants with Bi-Plateau Burning behavior. Defence Science and Technology. DSTO-GD-0344 Nov. 2002 pp. 1 to 23.

Robert M. Heramb et al., The manufacture of smokeless powders and their forensic analysis. Department of Chemistry Ohio University Athens Ohio. pp. 1 to 8.

Chuck Hawks, Smokeless powder. pp. 1 to 3.

Smokeless powder. Wikipedia. pp. 1 to 11.

* cited by examiner

DEVICE FOR CONTROLLING A RATE OF GAS PRESSURE INCREASE IN A GUN BARREL

CROSS REFERENCE TO RELATED APPLICATION

The present application is a continuation of U.S. Ser. No. 16/056,884 granted Sep. 8, 2020 as Pat. No., 10.767.967. All of the disclosure of U.S. Ser. No. 16/056,884 is incorporated herein by reference.

BACKGROUND OF THE INVENTION

Field of the Invention

The present invention relates to a device for controlling a rate of gas pressure increase in a gun barrel.

More specifically, the present invention relates to a device for controlling a rate of gas pressure increase generated by a propellant for propelling a projectile from an upstream towards a downstream end of a gun barrel.

Background Information

A gun cartridge disposed within a gun barrel typically includes a casing having an upstream and a downstream end. The upstream end of the casing includes a primer so that when the primer is struck, the outer surface of smokeless gunpowder propellant grains disposed within the casing burn and produce a large quantity of gas. The generation of gas within the casing rapidly increases the pressure within the upstream end of the gun barrel. This increase in gas pressure urges a projectile disposed at the downstream end of the casing to separate from the casing and accelerate towards a downstream end of the gun barrel.

However, because the outer surface only of the propellant grain burn, such burning of the outer surface rapidly burns and thus progressively reduces the surface area of the propellant grain. Such reduction in surface area of a propellant grain results in an initial very high generation of gas followed by a generation of a progressively lesser quantity of gas as the surface area of the propellant grain available for burning diminishes.

Consequently, the projectile is subjected to an initial pressure which is extremely high followed by a progressively lesser pressure as the projectile is propelled towards the downstream end of the barrel.

The aforementioned reduction in gas pressure between the upstream end of the gun barrel and the projectile is further decreased because the volume occupied by the gas within the gun barrel increases from an initial volume when the projectile is disposed adjacent to the upstream end of the gun barrel to a subsequent progressively larger volume occupied by the gas within the gun barrel when the projectile reaches the downstream end of the gun barrel.

In an attempt to progressively increase the rate of increase in gas pressure generated by the propellant, propellants have been manufactured having a macaroni type configuration. In such propellant, the reduction in the outside surface area as the propellant is burnt is compensated to a degree by the hollow internal surface of the propellant because such internal surface when burning tends to increase the surface area available for burning.

Additionally, various types of deterrent material have been applied to propellant surfaces in an attempt to slow down the initial rapid evolution of gas when the propellant surface burns.

Another attempt at controlling the rate of gas pressure generation during a propellant burning procedure involves providing various layers of propellant grains with each layer compacted to a different density.

All of the aforementioned proposals have met with very limited success in trying to achieve a controlled rate of gas pressure generation during a propellant burning operation.

Stick powders are becoming obsolescent for hand and shoulder firearms. Consequently, most powders currently used are so called "ball propellants" because they are cheaper to make and are more effective. These ball propellants typically include a plurality of balls of powder each ball being about 1 mm in diameter.

Such ball propellants are commonly manufactured as an emulsion. During and after drying, they may have ingredients added or coatings applied.

Throughout the specification the term "controlling the burning rate," is to be understood to mean " . . . creating and controlling a gas pressure increase as the projectile moves downstream."

Although in certain aspects of the present invention only a part of the surface of a powder ball or stick is described as being coated with flame retardant thus leaving holes in the flame retardant coating for the reception therein of the secondary primer, it may be more practical to tumble the powder ball with retardant coating and embed the secondary primers. However, it should be understood by those skilled in the art that the secondary primers burn through the flame-retardant coating with little or no delay.

Also, it should be understood that throughout the specification, the description of the combination of the essential ingredients of the powder ball or stick is a two or more part chemical combination.

The present invention provides a unique and simple way of controlling the rate of gas pressure generation when a propellant is burnt. According to the present invention, a propellant outer surface area is coated with a deterrent, that is a flame deterrent. The coated outer surface area of the propellant defines a deterrent free plurality of spaced surface areas of the propellant. When these deterrent free areas are ignited by a primer, each of the spaced surface areas burn and generate a crater having a wall which progressively exposes an increasing surface area of the propellant. Such increasing surface area of the propellant controls the rate of generation of gas pressure for accelerating the projectile towards the downstream end of the gun barrel.

Therefore, a primary object of the present invention is the provision of a control device which controls a rate of increase in gas pressure generated during burning of a propellant.

Another objective of the present invention is the provision of a control device which controls a rate of increase in gas pressure generated during burning of a propellant for permitting a reduction in a maximum pressure tolerance requirement for the gun barrel so that fabrication of the gun barrel from lighter materials is permitted.

Yet another object of the present invention is the provision of a control device which controls a rate of increase in gas pressure generated during burning of a propellant for permitting a reduction in a maximum pressure tolerance requirement for the gun barrel for reducing the weight and cost of the gun barrel.

Yet another object of the present invention is to reduce the cost of manufacture of propellant by varying the ratio of secondary primers to surface area to control the rate of combustion or "speed" of the propellant. The arrangement according to the present invention controls the rate of gas pressure increase by tumbling the powder balls with the secondary primers. More specifically, such manufacture according to the present invention includes rolling between surfaces to spread and embed the secondary primers.

A further object of the present invention is the provision of a control device which controls a rate of increase in gas pressure generated during burning of a propellant for permitting a more gradual increase in gas pressure as the projectile accelerates towards the downstream end of the gun barrel.

Other features and advantages of the present invention will be readily apparent to those skilled in the art by a consideration of the detailed description of a preferred embodiment of the present invention contained herein.

SUMMARY OF THE INVENTION

The present invention relates a device for controlling a rate of gas pressure increase generated by a propellant for propelling a projectile from an upstream towards a downstream end of a gun barrel. The device includes a first surface area defined by the propellant and a deterrent applied to a second surface area defined by the first surface area, the second surface area being less than the first surface area. The arrangement is such that the second surface area defines a deterrent free third surface area of the propellant. A primer is operatively disposed relative to the third surface area such that when the primer is activated, the third surface area of the propellant is ignited. The arrangement is such that firstly, while the third surface area is burning and generating gas between the upstream end of the gun barrel and the projectile, the rate of gas pressure increase begins to propel the projectile towards the downstream end of the gun barrel. Secondly, the third surface area of the propellant while burning exposes a progressively increasing surface area of the propellant for burning together with an associated increased generation of gas, the increasing surface area of the propellant defining a concave crater, the crater having a wall which progressively increases in surface area during the burning such that the rate of increase in gas pressure continues to increase for accelerating the projectile towards the downstream end of the gun barrel.

More specifically, the deterrent is applied to a percentage of the first surface area such that the percentage to which deterrent is applied defines the second surface area, the second surface area being less than the first surface area of the propellant.

Also, the second surface area to which deterrent is applied defines a deterrent free third surface area of the propellant such that the first surface area of the propellant is at least equal to a sum of the second and third surface areas.

The primer is operatively disposed relative to the deterrent free third surface area of the propellant such that when the primer is activated, the third surface area of the propellant is ignited so that firstly, while the third surface area is burning and generating gas between the upstream end of the gun barrel and the projectile, the rate of gas pressure increase begins to propel the projectile towards the downstream end of the gun barrel. Secondly, the deterrent free third surface area of the propellant while burning exposes a progressively increasing fourth surface area of the propellant for burning together with an associated increased generation of gas, the fourth surface area of the propellant defining a concave crater, the crater having a wall which progressively increases in surface area during the burning such that the rate of increase in gas pressure continues to increase for accelerating the projectile towards the downstream end of the gun barrel.

In a more specific embodiment of the present invention, the propellant includes a plurality of grains of smokeless gunpowder.

More particularly, each grain of smokeless gunpowder includes at least 50% by weight of nitrocellulose.

Moreover, the deterrent is a coating applied to the second surface area for retarding ignition of the second surface area to which the coating is applied.

Additionally, the percentage of the first surface area to which deterrent is applied is at least 80% of the first surface area.

Also, the deterrent free third surface area which is free of deterrent includes a plurality of spaced areas.

More specifically, the spaced areas are approximately equally spaced relative to each other and are each of approximately equal surface area.

In a preferred embodiment of the present invention, a secondary primer is disposed adjacent to each spaced area of the plurality of spaced areas such that when the primer is activated, the primer ignites each secondary primer for igniting each of the spaced areas.

Furthermore, each of the spaced areas, when ignited, burns the propellant for progressively generating the concave crater. The arrangement is such that the wall of the crater progressively exposes more surface area of the propellant for burning and the generation of more gas from the burning of the wall of the crater.

In another embodiment of the present invention, the secondary primer is disposed within an exposed cavity defined by each spaced area such that the secondary primer is easily ignited by the primer for burning each of the spaced areas.

The control of the rate of gas pressure increase generated by the propellant is preferably proportional to and at least commensurate with an increase in volume occupied by the gas from when the projectile is disposed adjacent to the upstream end of the gun barrel until the projectile reaches the downstream end of the gun barrel.

Moreover, the accelerating of the projectile progressively increases until the projectile reaches the downstream end of the gun barrel.

The controlling of the rate of gas pressure increase generated by the propellant progressively increases the gas pressure increase such that the gas pressure is relatively low when the projectile is disposed adjacent to the upstream end of the gun barrel but progressively increases until the projectile reaches the downstream end of the gun barrel thus permitting a reduction in a maximum pressure tolerance requirement for the gun barrel so that fabrication of the gun barrel from lighter materials is permitted.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

By way of example in order to illustrate and better understand the manufacture of ball propellant, if a 1 mm ball of powder were to be enlarged to the size of a basketball, this ball of powder is then coated with a flame retardant. The coated ball is then tumbled with secondary primers which in the present illustration would each be the size of a pea.

Twenty or so of these secondary primers are embedded into the flame retardant coating of the powder ball by the tumbling process. By virtue of the tumbling process, the secondary primers are more or less randomly scattered on the surface of the ball. When the primer in the cartridge case is fired and its flame contacts all the balls of power in the cartridge case, it is not hot enough to penetrate the flame-retardant surface and ignite the powder balls. However, it is hot enough to ignite the secondary primers which are attached to or hammered by the tumbling process into the flame-retardant surface. Consequently, each of the secondary primers ignites the adjacent surface of the powder ball. Therefore, the surface of the 1 mm ball of powder is burnt. As the flame burns uniformly away from each secondary primer, it creates a crater which is roughly hemispherical. As the surface of the hemisphere burns, it grows geometrically larger, producing more gas with each passing millisecond. Eventually, the craters merge and the burn ends, ideally as the bullet leaves the muzzle.

Such geometric enlargement of the burning surface of the 1 mm ball is a very important feature of the present invention. The volume of a hemisphere is $\frac{2}{3}\pi r^3$. The rate of increase of burning can be easily controlled during manufacture by varying the size and number of the secondary primers tumbled onto and embedded in the flame retardant coating.

BRIEF DESCRIPTION OF THE DRAWINGS

Similar reference characters refer to similar parts throughout the various views of the drawings.

Also, similar parts of the various embodiments of the present invention are indicated by the same reference characters but with a suffix added thereto.

DETAILED DESCRIPTION OF THE DRAWINGS

Figure 1:
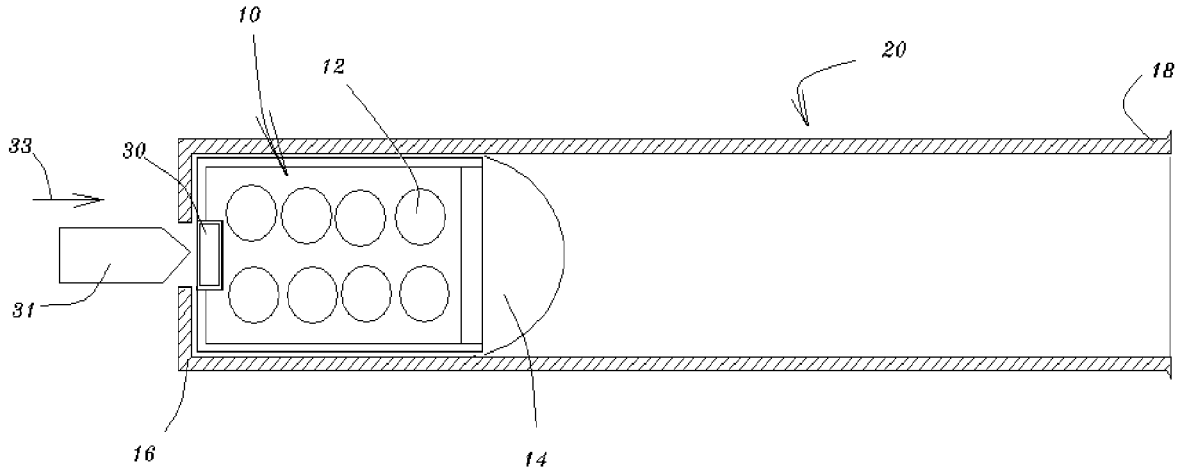
FIG. 1 is a side elevational view of a device according to the present invention, for controlling a rate of gas pressure increase generated by a propellant for propelling a projectile.

FIG. 1 is a side elevational view of a device generally designated 10 according to the present invention, for controlling a rate of gas pressure increase generated by a propellant 12 for propelling a projectile 14 from an upstream end 16 towards a downstream end 18 of a gun barrel generally designated 20.

Figure 2:
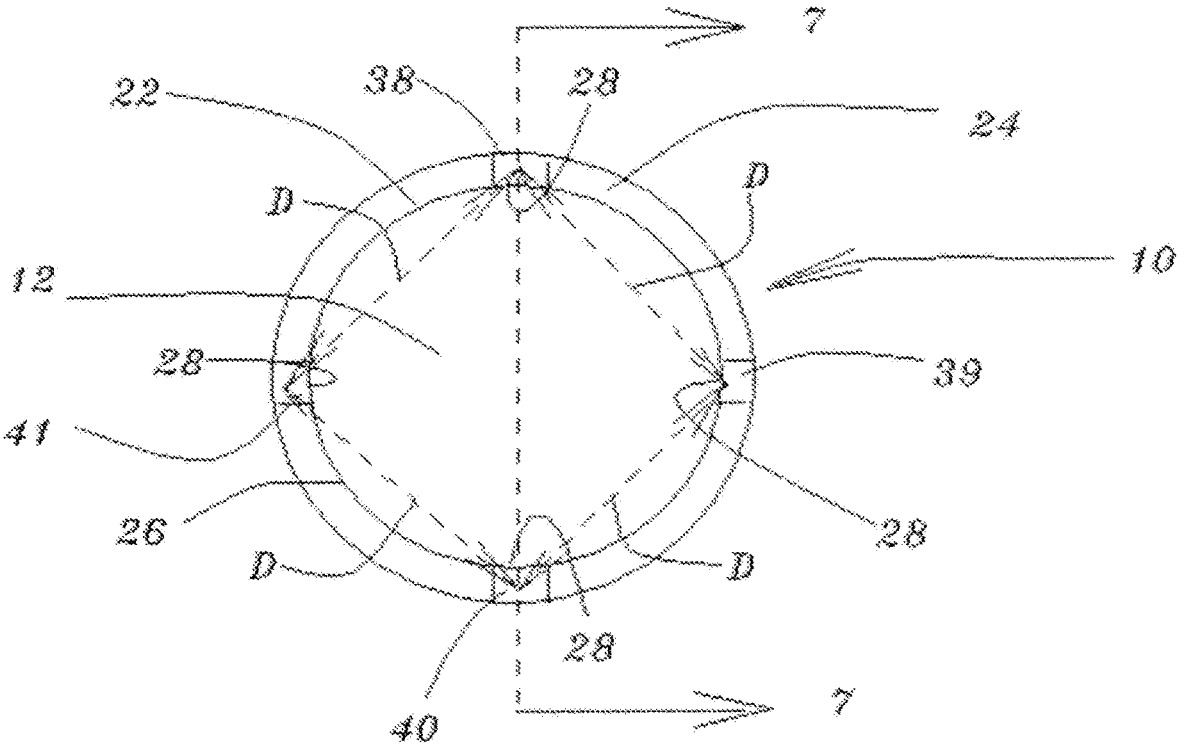
FIG. 2 is an enlarged sectional view of the propellant shown in FIG. 1.

FIG. 2 is an enlarged sectional view of the propellant 12 shown in FIG. 1. As shown in FIG. 2 the device 10 includes a first surface area 22 defined by the propellant 12 and a deterrent 24 applied to a percentage of the first surface area 22. The arrangement is such that the percentage of the first surface area 22 to which deterrent 24 is applied defines a second surface area 26, the second surface area 26 being less than the first surface area 22 of the propellant 12. The second surface area 26 to which deterrent 24 is applied defines a deterrent free third surface area 28 of the propellant 12 such that the first surface area 22 of the propellant 12 is at least equal to a sum of the second surface area 26 and the deterrent free third surface area 28.

Figure 3:
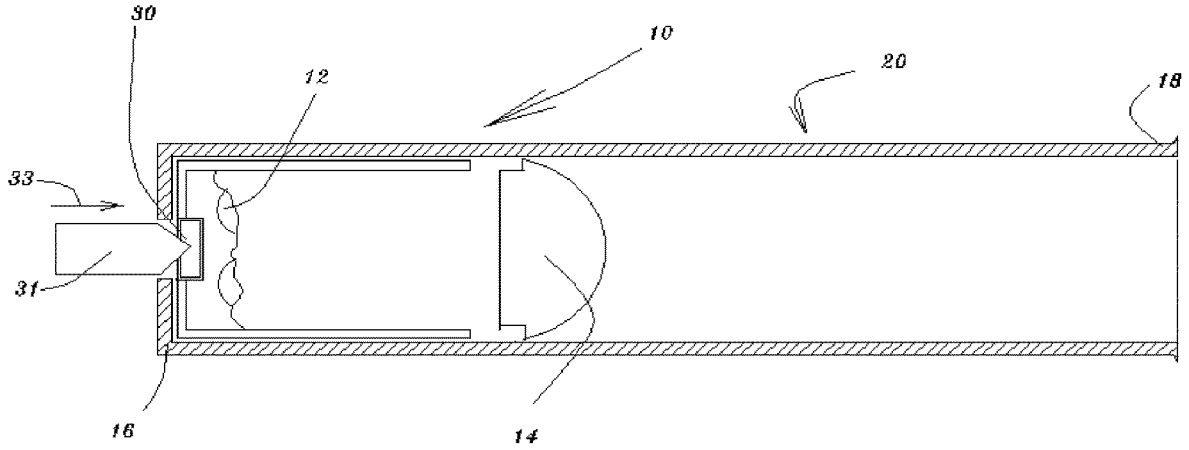
FIG. 3 is a similar view to that shown in FIG. 1 but shows a primer which is operatively disposed relative to the deterrent free third surface area of the propellant.

FIG. 3 is a similar view to that shown in FIG. 1 but shows a primer 30 which is operatively disposed relative to the deterrent free third surface area 28 of the propellant 12 shown in FIG. 2.

As shown in FIG. 3, when the primer 30 is activated by movement of a firing pin 31 to strike the primer 30 as indicated by the arrow 33, the deterrent free third surface areas 28 of the propellant 12 are ignited. Ignition and burning of the deterrent free third surface areas 28 of propellant 12 generates gas between the upstream end 16 of the gun barrel 20 and the projectile 14. The rate of gas pressure increase begins to propel the projectile 14 towards the downstream end 18 of the gun barrel 20.

Figure 4:
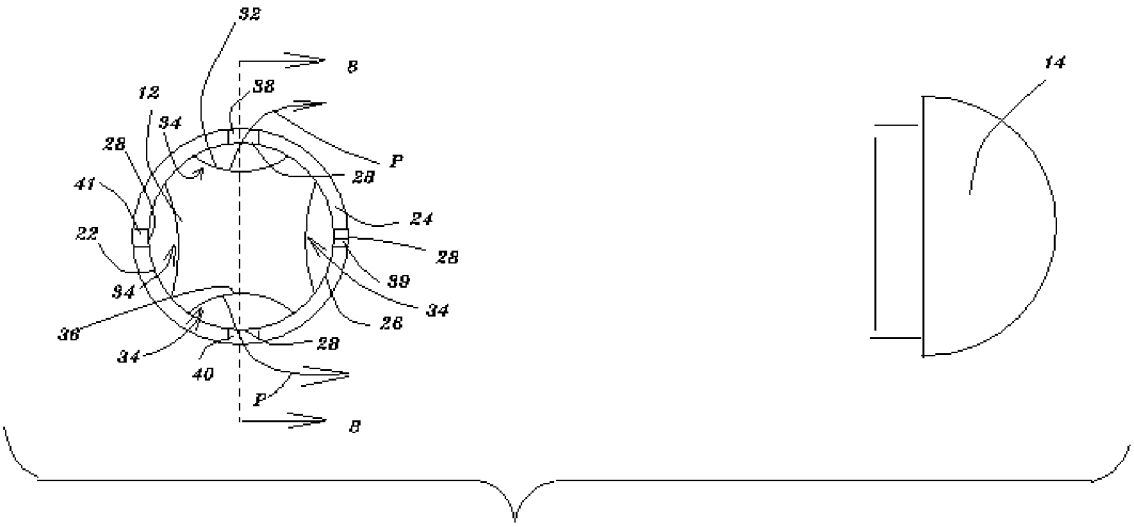
FIG. 4 is an enlarged side elevational view similar to that shown in FIG. 2 but shows the primer having ignited the deterrent free third surface areas of the propellant.

FIG. 4 is an enlarged side elevational view similar to that shown in FIG. 2 but shows the primer having ignited the deterrent free third surface areas 28 of the propellant 12. As shown in FIG. 4, the deterrent free third surface area 28 of the propellant 12 while burning exposes a progressively increasing fourth surface area 32 of the propellant 12 for burning together with an associated increased generation of gas. The fourth surface area 32 of the propellant 12 defines a concave crater generally designated 34, the crater 34 having a wall 36 which progressively increases in surface area during the burning such that the rate of increase in gas pressure as indicated by the arrows P, continues to increase for accelerating the projectile 14 towards the downstream end 18 of the gun barrel 20 as shown in FIG. 3.

Figure 5:
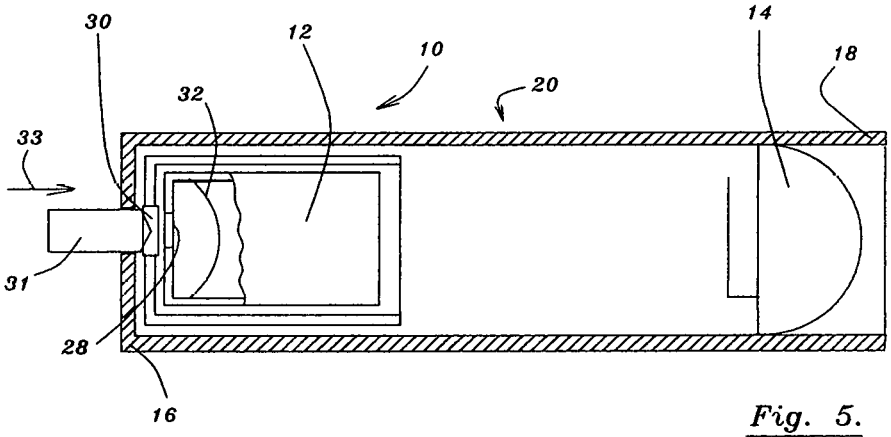
FIG. 5 is a similar view to that shown in FIG. 3 but shows the projectile having reached the downstream end of the gun barrel.

FIG. 5 is a similar view to that shown in FIG. 3 but shows the projectile 14 having reached the downstream end 18 of the gun barrel 20.

Figure 6:
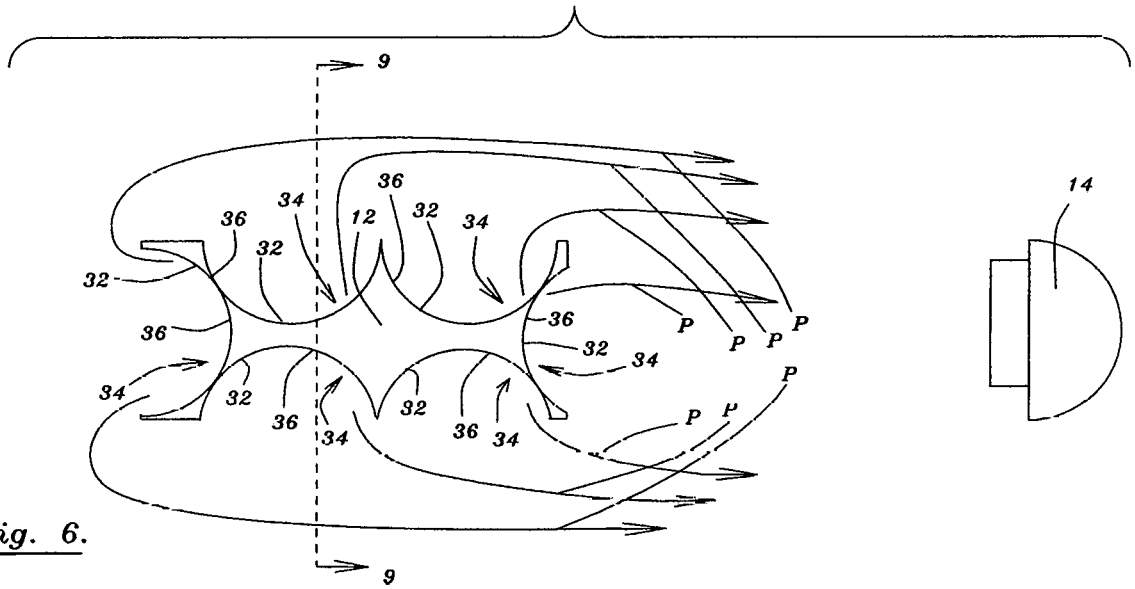
FIG. 6 is a similar view to that shown in FIG. 4 but shows the walls of the craters having progressively increased in surface area for exposing a maximum surface area of the propellant for burning.

FIG. 6 is a similar view to that shown in FIG. 4 but shows the walls 36 of the craters 34 having progressively increased in surface area for exposing a maximum surface area of the propellant 12 for burning.

In a more specific embodiment of the present invention, the propellant 12 includes a plurality of grains or particles of smokeless gunpowder. FIG. 1 for clarity shows eight grains 12 of propellant which is smokeless gunpowder. However, the cartridge case 11 shown in FIG. 1 may include any suitable number of grains 12 which may be spherical in shape as shown or in the form of cylindrical sticks.

More particularly, each grain of the smokeless gunpowder includes at least 50% by weight of nitrocellulose.

Figure 7:
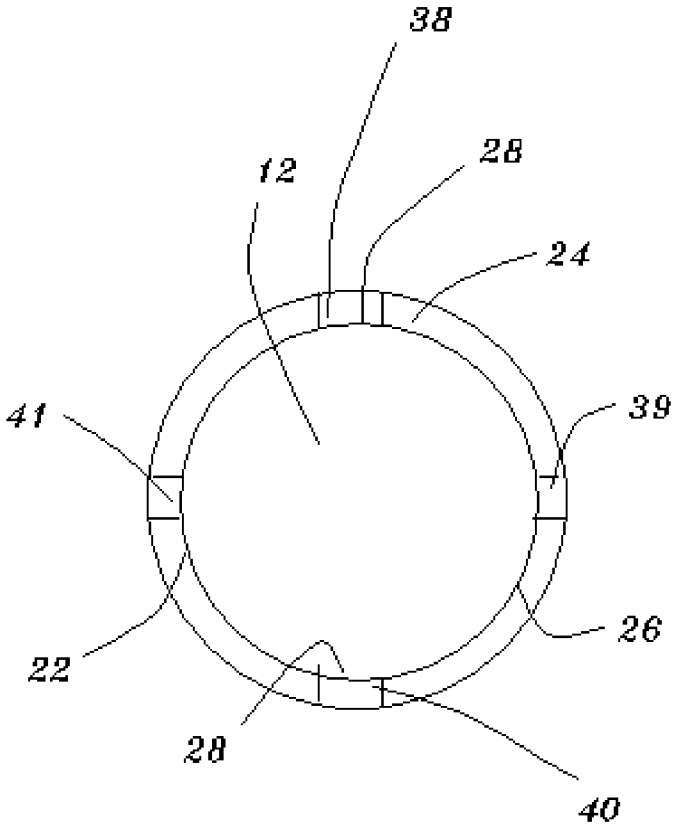
FIG. 7 is a sectional view of the propellant taken on the line 7-7 of FIG. 2.

FIG. 7 is a sectional view of the propellant 12 taken on the line 7-7 of FIG. 2. As shown in FIG. 7, the deterrent 24 is a coating applied to the second surface area 26 for retarding ignition of the second surface area 26 to which the coating of deterrent 24 is applied.

Additionally, the percentage of the first surface area 22 to which deterrent 24 is applied is at least 80% of the first surface area 22.

As shown in FIG. 2, the deterrent free third surface area 28 which is free of deterrent 24 includes a plurality of spaced areas 38, 39, 40 and 41. Although four spaced areas 38 to 41 are shown, any suitable number of spaced areas can be provided.

More specifically, the spaced areas 38 to 41 are approximately equally spaced by a distance D relative to each other and are each of approximately equal surface area.

Figure 8:
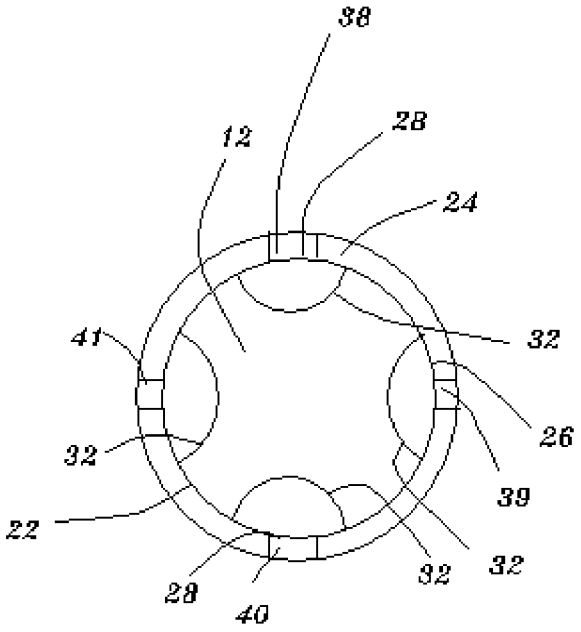
FIG. 8 is a sectional view taken on the line 8-8 of FIG. 4 and shows the propellant after ignition.

FIG. 8 is a sectional view taken on the line 8-8 of FIG. 4 and shows the propellant 12 after ignition.

Figure 9:
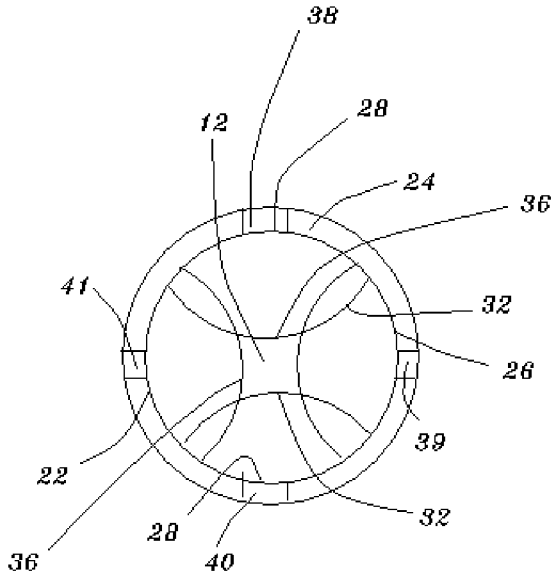
FIG. 9 is a view taken on the line 9-9 of FIG. 6.

FIG. 9 is a view taken on the line 9-9 of FIG. 6. As shown in FIG. 9 the propellant 12 has to a large extent been burnt and the walls 36 of the craters have exposed a maximum surface area.

Figure 10:
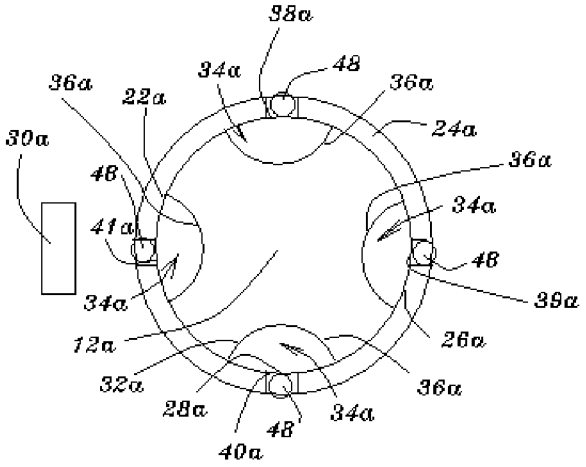
FIG. 10 is a similar view to that shown in FIG. 2 but shows another embodiment of the present invention.

FIG. 10 is a similar view to that shown in FIG. 2 but shows another embodiment of the present invention. As shown in FIG. 10, a secondary primer 48 is disposed adjacent to each spaced area such as spaced area 39*a* of the plurality of spaced areas 38*a* to 41*a* such that when the primer 30*a* is activated, the primer 30*a* ignites each secondary primer 48 for igniting each of the spaced areas 38*a* to 41*a*.

Furthermore, each of the spaced areas 38*a* to 41*a*, when ignited, burns the propellant for progressively generating the concave craters 34*a*. The arrangement is such that the wall 36*a* of each of the craters 34*a* progressively exposes more surface area of the propellant 12*a* for burning and generation of more gas from the burning of the walls 36*a* of the craters 34*a*.

Figure 11:
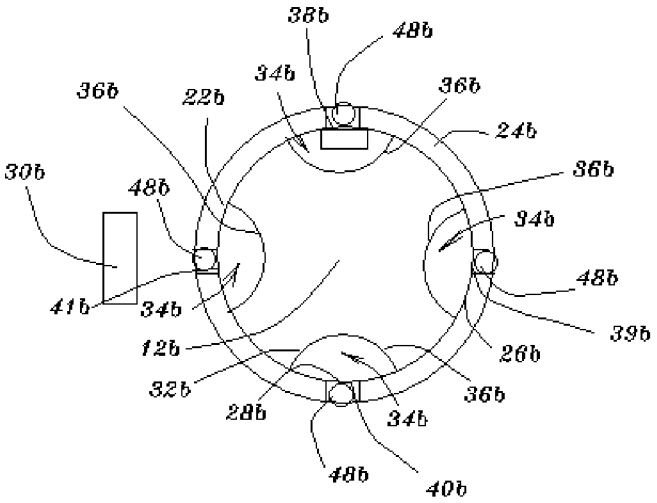
FIG. 11 is a similar view to that shown in FIG. 10 but shows another embodiment of the present invention.

FIG. 11 is a similar view to that shown in FIG. 10 but shows another embodiment of the present invention. As shown in FIG. 11, the secondary primer 48*b* is disposed within an exposed cavity 50 defined by each spaced area 38*b* to 41*b* such that the secondary primers 48*b* are easily ignited by the primer 30*b* for burning each of the spaced areas 38*b* to 41*b*.

Figure 12:
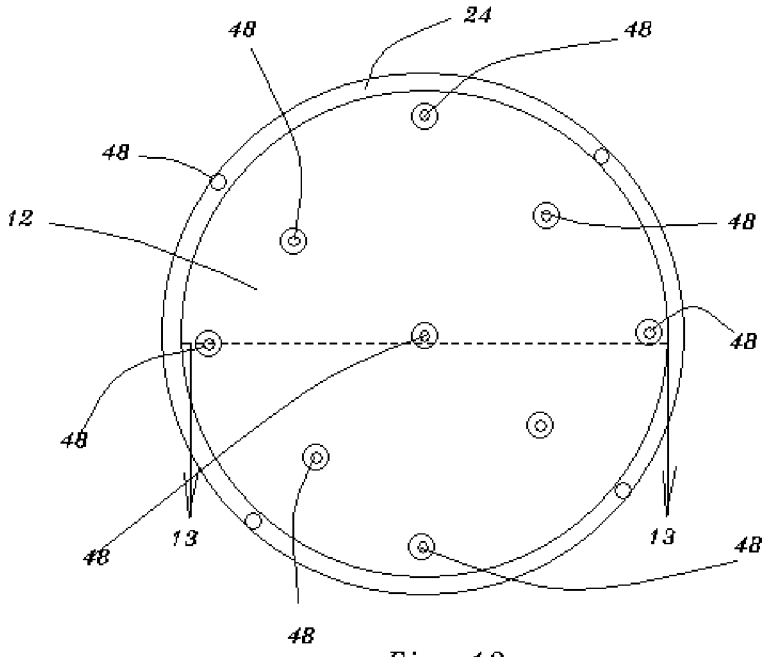
FIG. 12 is a greatly enlarged side elevational view of the embodiment shown in FIG. 10.

FIG. 12 is a greatly enlarged side elevational view of the embodiment shown in FIG. 10. As shown in FIG. 12, a ball of smokeless gunpowder propellant 12*a* has a deterrent 24*a* coating thereon with secondary primers 48*a* embedded in the deterrent 24*a* coating according to the present invention.

Figure 13:
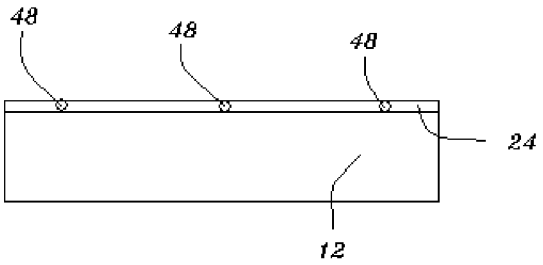
FIG. 13 is a sectional view taken on the line 13-13 of FIG. 12.

FIG. 13 is a sectional view taken on the line 13-13 of FIG. 12. As shown in FIG. 13, the secondary primer 48*a* is embedded in the deterrent coating 24*a*.

Figure 14:
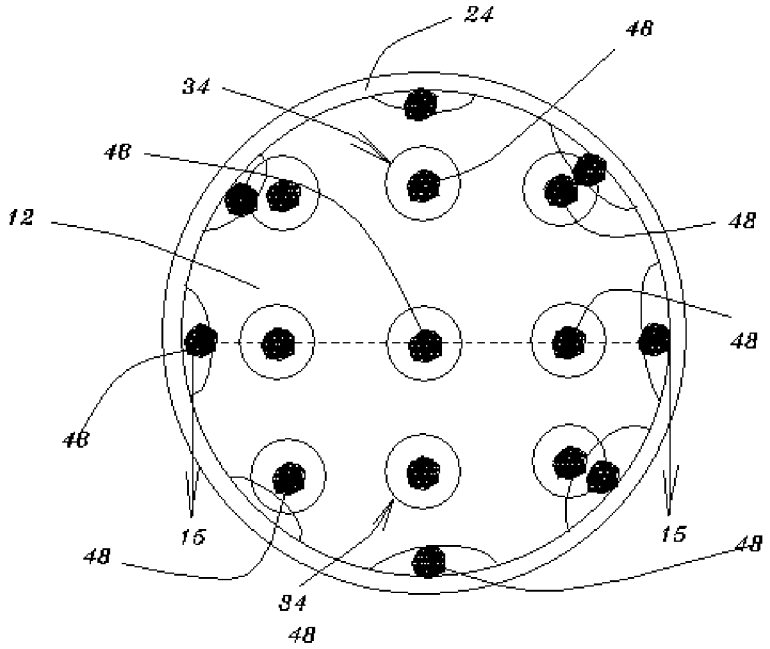
FIG. 14 is a similar view to that shown in FIG. 12 but shows the secondary primers having burnt semi spherical cavities or concave craters in the ball of smokeless gunpowder propellant.

FIG. 14 is a similar view to that shown in FIG. 12 but shows the secondary primers 48*a* having burnt semi spherical cavities or concave craters 34*a* in the ball of smokeless gunpowder propellant 12*a*.

Figure 15:
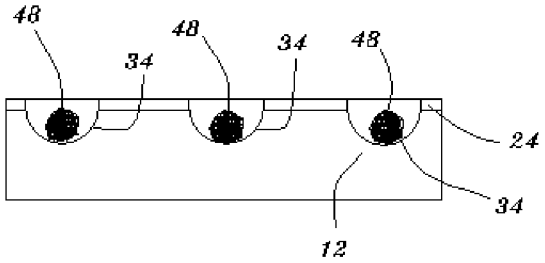
FIG. 15 is a sectional view taken on the line 15-15 of FIG. 14.

FIG. 15 is a sectional view taken on the line 15-15 of FIG. 14. As shown in FIG. 15, the craters 34*a* are of semi spherical configuration.

Figure 16:
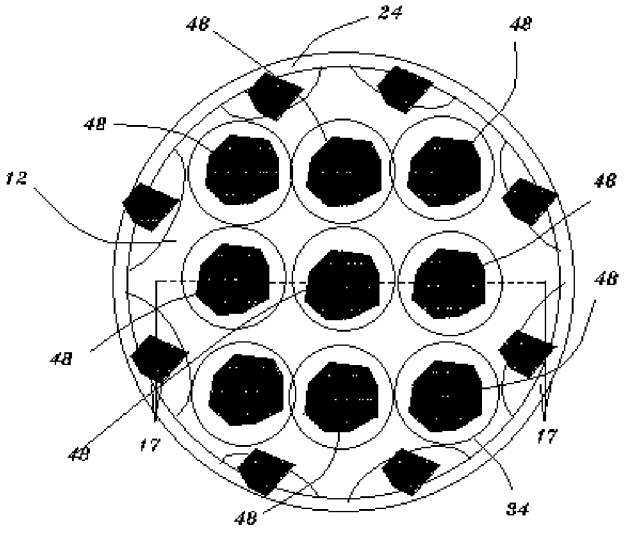
FIG. 16 is a similar view to that shown in FIG. 12 but shows the secondary primers having burnt semi spherical cavities in the ball of smokeless gunpowder propellant and that these cavities border each other.

FIG. 16 is a similar view to that shown in FIG. 12 but shows the secondary primers 48*a* having burnt semi spherical cavities 34*a* in the ball of smokeless gunpowder propellant 12*a* and that these cavities 34*a* border each other.

Figure 17:
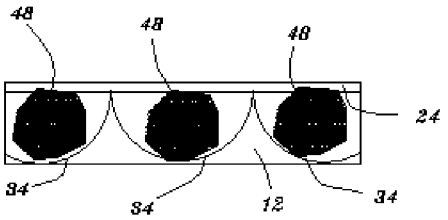
FIG. 17 is a sectional view taken on the line 17-17 of FIG. 16.

FIG. 17 is a sectional view taken on the line 17-17 of FIG. 16. As shown in FIG. 17, the cavities 34*a* have greatly enlarged exposing much more of the surface area of the propellant 12*a* for burning.

In each of the embodiments of the present invention, the control of the rate of gas pressure increase generated by the propellant 12 is proportional to and at least commensurate with an increase in volume occupied by the gas from when the projectile 14 is disposed adjacent to the upstream end 16 of the gun barrel 20 until the projectile 14 reaches the downstream end 18 of the gun barrel 20.

Moreover, the accelerating of the projectile 14 progressively increases until the projectile 14 reaches the downstream end 18 of the gun barrel 20.

The controlling of the rate of gas pressure increase generated by the propellant 12 progressively increases the gas pressure such that the gas pressure is relatively low when the projectile 14 is disposed adjacent to the upstream end 16 of the gun barrel 20 but progressively increases until the projectile 14 reaches the downstream end 18 of the gun barrel 20 thus permitting a reduction in a maximum pressure tolerance requirement for the gun barrel 20 so that fabrication of the gun barrel 20 from lighter materials is permitted.

In operation of the control device 10 according to the present invention, ignition of the primer 30 causes an ignition and burning of the deterrent free spaced areas 38 to 41 of the propellant 12. The burning of these spaced areas 38 to 41 generate craters 34 each having a wall 36 which progressively increases in surface area thereby exposing more of the surface area of the propellant 12 for burning together with the attendant generation of an increased quantity of gas. The arrangement is such that the increased quantity of gas within the gun barrel 20 increases the gas pressure for accelerating the projectile 14 towards the downstream end 18 of the gun barrel 20.

Additional disclosure is as follows:

A device allowing the calculated acceleration of burning over time of smokeless gunpowder.

The present invention relates to coating each particle of smokeless powder with a deterrent coating that has a specified number of holes or is impregnated with a specified number of secondary primers to accelerate the burning rate of smokeless powder over time.

More specifically, the present invention relates to a device for creating the ability for an accelerated rate of gas pressure increase generated by a propellant for propelling a projectile from an upstream towards a downstream end of a gun barrel by using a deterrent coating with holes or a complete coating of deterrent impregnated with secondary primers where ignition can take place. Both methods allow the geometric enlargement (the surface area of a hemisphere is ($2\pi r^2$) of the burning hemispherical surface at each of the holes in the deterrent or under the secondary primers embedded into the deterrent.

A gun cartridge disposed within a gun barrel typically includes a casing having an upstream and a downstream end. The upstream end of the casing includes a primer so that when the primer is struck, the outer surface of smokeless gunpowder propellant burns and produce a large quantity of gas. The generation of gas within the casing rapidly increase the pressure within the upstream end of the gun barrel. This increase in gas pressure urges a projectile disposed at the upstream end of the casing to separate from the casing and accelerate towards the downstream end of the gun barrel.

However, because the outer surface only of the propellant ball or grain burns, such burning of the outer surface rapidly burns and thus progressively reduces the surface area of the propellant grain. Such reduction in surface area of a propellant grain results in an initial very high generation of gas followed by a generation of a progressively lesser quantity of gas as the surface area of the propellant grain available for burning diminishes to zero.

Consequently, the projectile is subjected to an initial pressure which is extremely high followed by a progressively lesser pressure as the projectile is propelled towards the downstream end of the barrel.

The aforementioned reduction in gas pressure between the upstream end of the gun barrel and the projectile is further decreased because the volume occupied by the gas within the gun barrel increases from an initial volume when the projectile is disposed adjacent to the upstream end of the gun barrel to a subsequent progressively larger volume occupied by the gas within the gun barrel when the projectile reaches the downstream end of the gun barrel.

In an attempt to progressively increase and accelerate the rate of increase in gas pressure generated by the propellant, propellants have been manufactured having a macaroni type configuration. In such propellant, the reduction in the outside surface area as the propellant is burnt is increased to a degree by the hollow internal surface of the propellant because such internal surface when burning increases the surface area available for burning.

Additionally, various types of deterrent material have been applied to propellant surfaces in an attempt to slow down the initial rapid evolution of gas when the propellant surface burns.

Another attempt at controlling the rate of gas pressure generation during a propellant burning procedure involves providing various layers of propellant balls or grains with each layer compacted to a different density.

All of the aforementioned proposals have met with very limited success in trying to achieve a controlled rate of gas pressure generation during a propellant burning operation.

The present invention provides a unique and simple way of controlling the acceleration rate of gas pressure generation when a propellant is burnt. According to the present invention, a propellant outer surface area is coated with a deterrent. The coated outer surface area of the propellant defines a deterrent free plurality of spaced surface areas of the propellant. When these deterrent free areas are ignited by a primer, each of the spaced surface areas burn and generate a hemisphere having a wall which progressively exposes an increasing hemispherical surface area of the propellant at a rate of $2\pi r^2$. Such increasing surface area of the propellant accelerates the rate of generation of gas pressure for accelerating the projectile towards the downstream end of the gun barrel.

Therefore, a primary object of the present invention is the provision of a control device which controls the acceleration rate of increase in gas pressure generated during burning of a propellant.

Another objective of the present invention is the provision of a device which controls the acceleration rate of increase in gas pressure generated during burning of a propellant for permitting a reduction in a maximum pressure tolerance requirement for the gun breech and barrel so that fabrication of the gun from lighter materials is permitted.

Yet another object of the present invention is the provision of a device which controls the acceleration rate of increase in gas pressure generated during burning of a propellant for permitting a reduction in a maximum pressure tolerance requirement for the gun breech and barrel for reducing the weight and cost of the gun.

A further object of the present invention is the provision of a device which controls the acceleration rate of increase in gas pressure generated during burning of a propellant for permitting a gradual start and accelerated increase in gas pressure as the projectile accelerates towards the downstream end of the gun barrel.

Other features and advantages of the present invention will be readily apparent to those skilled in the art by a consideration of the detailed description of a preferred embodiment of the present invention contained herein.

The present invention relates to a device for controlling a rate of the accelerated gas pressure increase generated by a propellant for propelling a projectile from an upstream end towards a downstream end of a gun barrel. The device includes a first surface area defined by the propellant and a deterrent applied to a percentage of the first surface area. The arrangement is such that the percentage of the first area to which deterrent is applied defines a second surface area. The second surface area has small holes exposing the first surface area of the propellant. The second surface area of this deterrent with holes defines a deterrent free surface area of the propellant such that the first surface area of the propellant is at least equal to a sum of the deterrent plus the holes. A primer is operatively disposed relative to the deterrent free surface area of the propellant such that when the primer is activated, the holes in the deterrent ignite the propellant. The arrangement is such that firstly, while the exposed surface area which is the deterrent free surface area is burning and generating gas between the upstream end of the gun barrel and the projectile, the controlled acceleration rate of gas pressure increase begins to propel the projectile towards the downstream end of the gun barrel. Secondly, the deterrent free surface area of the propellant while burning exposes a progressively increasing hemispherical surface area of the propellant for burning together with an associated increased generation of gas based on the expanding area of $2\pi r^2$. Each hole in the deterrent surface area over the propellant defines a concave hemisphere, the hemisphere having a wall which progressively increases in surface area by a factor of $2\pi r^2$ during the burning such that the rate of acceleration in gas pressure continues to increase for accelerating the projectile towards the downstream end of the gun barrel until the propellant is consumed.

Secondly, the present invention relates to a device for controlling a rate of the accelerated gas pressure increase generated by a propellant for propelling a projectile from an upstream end towards a downstream end of a gun barrel. The device includes a first surface area defined by the propellant and a deterrent applied to the entire propellant first surface area. The arrangement is such that the deterrent is considered a second surface area where secondary primers are impregnated into the deterrent. This can be done by a tumbling process or rolling between surfaces to spread and embed the secondary primers. A primer is operatively disposed relative to the secondary primers embedded on the deterrent surface area of the propellant such that when the primer is activated, the secondary primers in the deterrent ignite the propellant. The arrangement is such that firstly, while the secondary primers expose holes to the propellant surface area those holes start burning and generating gas between the upstream end of the gun barrel and the projectile, the controlled acceleration rate of gas pressure increase begins to propel the projectile towards the downstream end of the gun barrel. Secondly, the embedded primers within the deterrent surface area burns exposing a progressively increasing hemispherical surface area of the propellant for burning with an associated increased generation of gas based on the expanding area of $2\pi r^2$. Each secondary primer within the deterrent surface area over the propellant defines a concave hemisphere, the hemisphere having a wall which progressively increases in surface area by a factor of $2\pi r^2$ during the burning such that the rate of acceleration in gas pressure continues to increase for accelerating the projectile towards the downstream end of the gun barrel until the propellant is consumed.

In a more specific embodiment of the present invention, the propellant includes a plurality of balls, grains and any other shape of smokeless gunpowder.

More particularly, each ball, grain or other shape of smokeless gunpowder includes at least 50% by weight of nitrocellulose.

Moreover, the deterrent is a coating applied to the surface area of the propellant for retarding ignition of the second surface area to which the coating is applied.

Additionally, the percentage of the first surface area to which deterrent is applied is at least 80% of the first surface area when using holes and 100% of the first surface when embedding secondary primers.

In a preferred embodiment of the present invention, a secondary primer is disposed adjacent to each spaced area of the plurality of spaced areas such that when the primer is activated, the primer ignites each secondary primer for igniting each of the spaced areas.

Furthermore, each of the spaced areas, when ignited, burns the propellant for progressively generating the concave hemisphere. The arrangement is such that the wall of the hemisphere progressively exposes more surface area of the propellant for burning and the accelerated generation of more gas from the burning of the wall of the hemisphere.

In another embodiment of the present invention, the secondary primer is impregnated on the applied deterrent defined by each spaced area such that the secondary primer is easily ignited by the primer for burning each of the spaced areas.

The accelerated rate of gas pressure increase generated by the propellant is preferably proportional to and at least commensurate with an increase in volume occupied by the gas from when the projectile is disposed adjacent to the upstream end of the gun barrel until the projectile reaches the downstream end of the gun barrel.

Moreover, the accelerating of the projectile progressively increases until the projectile reaches the downstream end of the gun barrel.

The accelerating rate of gas pressure increase generated by the propellant progressively increases the gas pressure increase such that the gas pressure is relatively low when the projectile is disposed adjacent to the upstream end of the gun barrel but progressively increases until the projectile reaches the downstream end of the gun barrel thus permitting a reduction in a maximum pressure tolerance requirement for the gun breech and barrel so that fabrication of the gun breech and barrel from lighter materials is permitted.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

Invention Descriptive Overview When Using Ball Propellant: Imagine a 1 mm ball of powder enlarged to the size of a basketball and coated with flame retardant. Now it is tumbled with secondary primers which are the size of peas. Say Twenty are embedded into the powder ball by the process. By the nature of tumbling, they are more or less randomly scattered on the surface of the ball, however if rolled into the surface they would be less random. Now the primer in the cartridge case is fired. Its flame contacts all the balls of powder in the case. It is not hot enough to penetrate the deterrent, which is a flame-retardant surface and ignite the powder balls. It is hot enough to ignite the secondary primers which are attached to/embedded into the deterrent surface. Each secondary primer ignites the adjacent surface of the powder ball. As the flame burns uniformly away from each secondary primer, it creates a hemispherical crater. As the surface of the hemisphere burns, it grows geometrically larger, producing more gas with each passing millisecond. Eventually, the craters merge and the burn ends, ideally as the bullet leaves the muzzle.

This geometric enlargement (the surface area of a hemisphere is ($2\pi r^2$) of the burning second surface is the essence of the invention. The rate of increase can be easily controlled in manufacture by varying the size and count of the secondary primers.

In each of the embodiments of the present invention, the control of the rate of gas pressure increase generated by the propellant 12 is proportional to and at least commensurate with an increase in volume occupied by the gas from when the projectile 14 is disposed adjacent to the upstream end 16 of the gun barrel 20 until the projectile 14 reaches the downstream end 18 of the gun barrel 20.

Moreover, the accelerating of the projectile 14 progressively increases until the projectile 14 reaches the downstream end 18 of the gun barrel 20.

The controlling of the rate of gas pressure increase generated by the propellant 12 progressively increases the gas pressure such that the gas pressure is relatively low when the projectile 14 is disposed adjacent to the upstream end 16 of the gun barrel 20 but progressively increases until the projectile 14 reaches the downstream end 18 of the gun barrel 20 thus permitting a reduction in a maximum pressure tolerance requirement for the gun barrel 20 so that fabrication of the gun barrel 20 from lighter materials is permitted.

In operation of the control device 10 according to the present invention, ignition of the primer 30 causes an ignition and burning of the deterrent free spaced areas 38 to 43 of the propellant 12. The burning of these spaced areas 38 to 43 generate hemispheres 34 each having a wall 36 which progressively increases in surface area thereby exposing more of the surface area of the propellant 12 for burning together with the attendant generation of an increased quantity of gas. The arrangement is such that the increased quantity of gas within the gun barrel 20 increases the gas pressure for accelerating the projectile 14 towards the downstream end 18 of the gun barrel 20.

The present invention provides a unique arrangement for controlling a rate of gas pressure increase generated by a propellant for propelling a projectile from an upstream towards a downstream end of a gun barrel for permitting a reduction in the weight, size and cost of the gun barrel.

The present invention provides a unique arrangement for controlling a rate of gas pressure increase generated by a propellant for propelling a projectile from an upstream towards a downstream end of a gun barrel for permitting a reduction in the weight, size and cost of the gun barrel.

What is claimed is:

1. A propellant device for controlling generation of a rate of gas pressure increase for propelling a projectile from an upstream towards a downstream end of a gun barrel, said propellant device comprising:

a propellant defining an outer surface area;

a deterrent applied to said outer surface area of said propellant;

a secondary primer operatively disposed relative to, and cooperating with said propellant and extending through said deterrent into surface contact with said outer surface area of said propellant, so that said surface contact between said secondary primer and said outer surface of said propellant defines a deterrent free surface area such that, when said secondary primer is activated, said deterrent free surface area of said propellant is ignited so that firstly, while said deterrent free surface area is burning and generating gas between the upstream end of the gun barrel and the projectile, the rate of gas pressure increase begins to propel the projectile towards the downstream end of the gun barrel, secondly, said deterrent free surface area of the propellant while continuing to burn, exposes a progressively increasing surface area of the propellant for burning together with an associated increased generation of gas, said increasing surface area of the propellant for burning defining a crater;

said crater having a wall which progressively increases in surface area during said burning such that the rate of increase in gas pressure continues to progressively increase for accelerating the projectile towards the downstream end of the gun barrel;

said deterrent is applied to a percentage of said outer surface area such that said percentage to which deterrent is applied defines a further surface area, said further surface area being less than said outer surface area of the propellant;

said further surface area to which deterrent is applied defining said deterrent free surface area of the propellant such that said outer surface area of the propellant is equal to a sum of said further and said deterrent free surface areas; and a primer operatively disposed relative to said deterrent free surface area of the propellant such that when said primer is activated, said deterrent free surface area of the propellant is ignited so that firstly, while said deterrent free surface area is burning and generating gas between the upstream end of the gun barrel and the projectile, the rate of gas pressure increase begins to propel the projectile towards the downstream end of the gun barrel, secondly, said deterrent free surface area of the propellant while burning exposes a progressively increasing surface area of the propellant for burning together with an associated increased generation of gas, said progressively increasing surface area of the propellant defining said crater, said crater having a wall which progressively increases in surface area during said burning such that the rate of increase in gas pressure continues to increase for accelerating the projectile towards the downstream end of the gun barrel.

2. A propellant device for controlling generation of a rate of gas pressure increase for propelling a projectile from an upstream towards a downstream end of a gun barrel, said propellant device comprising:

a propellant defining an outer surface area;

a deterrent applied to said outer surface area of said propellant;

a secondary primer operatively disposed relative to, and cooperating with said propellant and extending through said deterrent into surface contact with said outer surface area of said propellant, so that said surface contact between said secondary primer and said outer surface of said propellant defines a deterrent free surface area such that, when said secondary primer is activated, said deterrent free surface area of said propellant is ignited so that firstly, while said deterrent free surface area is burning and generating gas between the upstream end of the gun barrel and the projectile, the rate of gas pressure increase begins to propel the projectile towards the downstream end of the gun barrel, secondly, said deterrent free surface area of the propellant while continuing to burn, exposes a progressively increasing surface area of the propellant for burning together with an associated increased generation of gas, said increasing surface area of the propellant for burning defining a crater;

said crater having a wall which progressively increases in surface area during said burning such that the rate of increase in gas pressure continues to progressively increase for accelerating the projectile towards the downstream end of the gun barrel; and said percentage of said outer surface area to which deterrent is applied is at least 80% of said outer surface area.

3. A propellant device for controlling generation of a rate of gas pressure increase for propelling a projectile from an upstream towards a downstream end of a gun barrel, said propellant device comprising:

a propellant defining an outer surface area;

a deterrent applied to said outer surface area of said propellant;

a secondary primer operatively disposed relative to, and cooperating with said propellant and extending through said deterrent into surface contact with said outer surface area of said propellant, so that said surface contact between said secondary primer and said outer surface of said propellant defines a deterrent free surface area such that, when said secondary primer is activated, said deterrent free surface area of sand propellant is ignited so that firstly, while said deterrent free surface area is burning and generating gas between the upstream end of the gun barrel and the projectile, the rate of gas pressure increase begins to propel the projectile towards the downstream end of the gun barrel, secondly, said deterrent free surface area of the propellant while continuing to burn, exposes a progressively increasing surface area of the propellant for burning together with an associated increased generation of gas, said increasing surface area of the propellant for burning defining a crater;

said crater having a wall which progressively increases in surface area during said burning such that the rate of increase in gas pressure continues to progressively increase for accelerating the projectile towards the downstream end of the gun barrel; and said deterrent free surface area which is free of deterrent includes:

a plurality of spaced areas.

4. A propellant device for controlling generation of a rate of gas pressure increase as set forth in claim 3 wherein said spaced areas are equally spaced relative to each other.

5. A propellant device for controlling generation of a rate of gas pressure increase as set forth in claim 3 wherein said spaced areas are each of equal surface area.

6. A propellant device for controlling generation of a rate of gas pressure increase as set forth in claim 3 wherein: said secondary primer is disposed adjacent to each spaced area of said plurality of spaced areas such that when said primer is activated, said primer ignites each secondary primer for igniting each of said spaced areas.

* * * * *